US006036793A

United States Patent [19]

Melgaard et al.

[11] Patent Number: 6,036,793

[45] Date of Patent: Mar. 14, 2000

[54] METHOD OF HEAT TREATING OXYGEN-SENSITIVE PRODUCTS

[75] Inventors: Hans L. Melgaard, North Oaks; Louis A. Larson, Golden Valley, both of Minn.

[73] Assignee: Despatch Industries Limited Partnership, Minneapolis, Minn.

[21] Appl. No.: 08/949,769

[22] Filed: Oct. 14, 1997

Related U.S. Application Data

[63] Continuation of application No. 08/659,067, Jun. 4, 1996, abandoned, which is a continuation of application No. 08/351,589, Dec. 7, 1994, abandoned.

[51] Int. Cl.[7] ..... C22F 1/16

[52] U.S. Cl. ..... 148/708; 148/712; 266/255; 432/2

[58] Field of Search ..... 148/708, 633, 148/712; 266/255, 259, 256; 432/2, 18, 68

[56] References Cited

U.S. PATENT DOCUMENTS

| | | | |
|---|---|---|---|
| 3,198,503 | 8/1965 | Eichelberg et al. | 432/81 |
| 3,431,002 | 3/1969 | Melgaard | 292/251.5 |
| 3,788,651 | 1/1974 | Brown et al. | 277/34 |
| 4,208,572 | 6/1980 | Melgaard | 219/400 |
| 4,460,332 | 7/1984 | Lawler et al. | 432/72 |
| 4,722,151 | 2/1988 | Westwell | 49/477 |
| 5,300,453 | 4/1994 | Okamura et al. | 437/142 |

OTHER PUBLICATIONS

Product Brochures (210), Despatch Oven Company, Chemical Drying, Sterilizing and Clean Room Ovens, published in the United States at least as early as Dec. 6, 1993.

Product Brochure (209), Despatch Industries, Inc., "Burn–In Ovens", published in the United States at least as early as Dec. 6, 1993.

Catalog 600–284, Despatch Industries Inc., "Laboratory Oven and Environmental Chamber Catalog", published in the United States at least as early as Dec. 6, 1993 (believed to have been published in 1984).

*Primary Examiner*—Sikyin Ip
*Attorney, Agent, or Firm*—Fredrikson & Byron, P.A.

[57] ABSTRACT

The present invention provides a method of heat-treating an oxygen-sensitive workpiece to minimize any oxidation of the workpiece, as well as an improved door seal specially suited for use with oxygen-sensitive products. In the method, an oven has an oven chamber and an outer housing, with an enclosure being defined therebetween. The workpiece is placed in the oven chamber and the chamber is sealed. Heated inert gas is circulated within the enclosure to heat the oven chamber and to hold it at a desired treatment temperature. The oven chamber is then cooled to a threshold temperature of the workpiece using inert gas. The chamber is then cooled further by circulating aerobic gas, preferably ambient air, within the enclosure. Another embodiment of the invention provides an oven with a housing forming an oven chamber, the oven chamber having a door opening in one of said walls. The oven also has a heated door and an inflatable seal carried by either the door or the housing, the seal extending about the area of contact between the door and the housing, the seal being filled with a nitrogen-containing gas.

15 Claims, 7 Drawing Sheets

METHOD OF HEAT TREATING OXYGEN-SENSITIVE PRODUCTS

This application is a continuation, of application Ser. No. 08/659,067 filed Jun. 4, 1996, now abandoned, which is a continuation, of application Ser. No. 08/351,589, filed Dec. 7, 1994 now abandoned.

BACKGROUND OF THE INVENTION

1. Field of the Invention the present invention relates to temperature controlled ovens, particularly ovens employed in the stages of fabricating micro-electronic semi-conductor devices and the like.

2. Description of the Prior Art

In the production of solid-state micro-electronic devices, such as multi-layered LSI circuit chips, it is necessary to repetitively subject work in process to elevated, constant temperature. Such solid state devices include circuitry which is becoming smaller and more complex as time goes on. As the circuitry is miniaturized, flaws introduced during manufacture become more problematic. In order to avoid flaws caused by contaminants during the heat treatment of these devices, it is important that the heat treatment environment be substantially free of possible contaminants.

Contaminants in the heated atmosphere substantially decrease the yield obtained in producing substrates for integrated circuits, microprocessors, LSI circuit arrays and the like. Many ordinary commercial ovens are known to produce in excess of 50,000 particles 0.5 microns or larger in a cubic foot of air. For the processing of solid state electronic devices, it is desired to reduce the particle level within a processing oven to not more than 100 particles 0.5 microns or larger per cubic foot of air. Elimination of particles below this standard has not been reliably achieved by conventional processing ovens, particularly for high temperature applications.

Contamination is generated by the heating elements, and particularly ceramic disks used to support the heating elements, within a heat controlled oven. Additionally, the silicon wafers or other chip substrates may themselves contaminate the oven chamber. The fiberglass insulation of the oven enclosure also produces some contamination. External contamination has been introduced to the oven from the blower and the blower motor.

Prior efforts to construct heat treating ovens for such purposes have centered on making the oven chambers readily cleanable. Rounded corners have been provided and care has been exercised in the use and selection of materials within the oven. In addition, in heated air ovens of the type disclosed in U.S. Pat. No. 4,460,332, a removable second subassembly with an air filter is provided in an attempt to satisfy class 100 air purification standards.

Frequently, heat treatment of electronic substrates requires processing within inert atmospheres in order to minimize oxidation of silicon and metallized layers which may be present, as the possibility of oxidation increases with higher temperature. In such cases, a special inert atmosphere oven is required that is constructed so as to minimize leakage of air into the oven or leakage of inert atmosphere out of the oven through the door seal, fan motor shaft seal, seams, or any penetration through oven walls. Such an oven is typified by the Despatch Industries Model LND 1-42 inert atmosphere bench oven. In such ovens, inert gas, such as nitrogen, is typically fed into the oven chamber within which silicon wafers have been placed. Flow of the filtered nitrogen is typically controlled by purge and maintain flowmeters. A three-way valve is usually supplied to select the purge or maintain flow levels.

The nitrogen in the Model LND 1-42 oven and similar inert atmosphere ovens is typically recirculated through a HEPA filter to remove particles from the oven environment. This helps eliminate both particles introduced in the nitrogen supplied to the oven, which is typically unfiltered, and particles which may be generated by the workpiece itself. However, this type of oven suffers from an inherent functional temperature limitation of about 220°0 C. due to the use of the HEPA filters in recirculating nitrogen within the oven. Although some HEPA filters can be used above 220° C., for a brief period of time, prolonged or frequent use of the filters at such temperatures will tend to cause the binders used in the filters to degrade. When these filters are then heated or cooled, they will tend to shed particles, making the filters themselves a source of the particles they are intended to remove.

One could use prefiltered nitrogen to pass into the furnace and pass the nitrogen through the oven only once, leaving the HEPA filter in a cooler environment to eliminate shedding. However, this solution tends to be too expensive to use on a commercial basis for at least two reasons. First, such single-pass operation will require a constant, relatively high volume supply of fresh nitrogen. As such nitrogen tends to be more expensive than other, more conventional gases (e.g. air), this is frequently cost prohibitive to use on a commercial scale. Additionally, the nitrogen will all have to be heated to the desired oven temperature or above, increasing fuel costs as compared to a recirculating system wherein heated gas is retained in the oven. Hence, both ovens using in-line HEPA filters, such as the Model LND 1-42 oven, and single-pass ovens have inherent limitations which prevent them from being used in a commercially effective manner for high temperature heat treatment when an inert atmosphere is necessary.

In addition to the use of an inert gas atmosphere, it is necessary to insure that the elevated temperatures within the heated chamber are relatively constant and do not vary by more than a stated number of degrees between any two points in the chamber. Close temperature uniformity throughout an oven chamber makes processing of any product more reliable. In general, product consistency is improved by increasing the amount of inert gas recirculation around the work in process as this will tend to minimize temperature variations in the chamber. Because uniformity is temperature dependant, product variability generally increases as oven temperature increases. Thus, it is also necessary to insure that a temperature controller operates accurately and quickly in response to temperature changes detected by thermocouples situated within the chamber to reduce variability from one product run to the next and to minimize localized temperature variations within the chamber during a single run.

Typically, an inert gas, such as nitrogen, is filtered through a class 1 or better filter as it is recirculated within the enclosure or chamber to contact the work in process. In the despatch industries Model LND 1-42 inert atmosphere bench oven, forced convected heat is employed as described above. Forced convection utilizes a fan to create gas flow which supplies heat more effectively to all parts of the chamber. The addition of forced air flow represents a significant improvement in overall temperature uniformity and in the time to transfer heat to the work in process. Air directed against a product heats it up much faster then merely surrounding the product with heat and prevents stratifications and other localized temperature variations sometimes found in gravity ovens.

Recirculating air flow, on the other hand, recreates a specific air distribution pattern throughout the chamber that depends on the inlet and outlet locations, the size of the chamber, the positioning of baffles, the air flow output of the fan, and other factors. This pattern can itself introduce some temperature variations within the chamber. Recirculating air or inert gas flow may also be disadvantageous when employed in the processing of integrated circuits as it may recirculate contaminants over the substrates.

Moreover, at higher temperatures (e.g. above about 300° C.), radiant heat transfer becomes of greater significance in bringing the temperature of work in process to the radiant heating element temperature. Radiant heating, advantageously, may provide temperature uniformity if the radiant heat is uniformly emitted from all points surrounding the work in process. It has been difficult to achieve such uniformity of emitted radiant heat in conventional heat treatment ovens, though, as radiant heat can be dependent upon the geometry of the oven and the relative position of the workpiece within the oven.

Many micro-electronic devices, including multi-layered LSI circuit chips and the like, are particularly sensitive to the presence of oxygen when the device is being processed. For many such devices, the presence of even a minimal amount of oxygen within the oven in which it is being heated can oxidize a sufficient portion of the work in progress to yield an unacceptable final device. In the past, a positive pressure of heated inert gas was maintained within the chamber to prevent the influx of ambient air into the chamber. Such an extensive use of nitrogen or other inert gas, however, will tend to increase fabrication costs for the devices as such inert gases are more expensive than other, more common gases, such as air.

SUMMARY OF THE INVENTION

The present invention provides a method of heat-treating an oxygen-sensitive workpiece to minimize any risk of unwanted oxidation of the workpiece during the heat treatment, as well as an improved oven having a door seal specially suited for use with oxygen-sensitive products. In accordance with a method of the invention, an oven is provided, the oven having an oven chamber and an outer housing, an enclosure being defined between the oven chamber and the outer housing. The oxygen-sensitive workpiece is placed into the oven chamber and the oven chamber is substantially sealed from the exterior environment and the enclosure.

Heated inert gas is then circulated within the enclosure to increase the temperature within the oven chamber from a threshold temperature of the workpiece, e.g. about 125° C., to a higher treatment temperature. Heated inert gas may continue to be circulated within the enclosure to hold the temperature within the oven chamber at the desired said treatment temperature for a fixed period of time before the temperature within the oven chamber is reduced from the treatment temperature to the threshold temperature by reducing the temperature of the inert gas within the enclosure. The final cool-down, i.e. between threshold temperature and a cooler terminal temperature is achieved by circulating a cooler aerobic gas, which may simply be ambient air, within the enclosure.

As noted above, another embodiment of the invention provides a door seal which is particularly well suited for use in connection with ovens used to heat treat oxygen-sensitive workpieces. In accordance with this embodiment of the invention, the oven comprises a housing having top, bottom and side walls forming an oven chamber substantially sealed from the external environment, the oven chamber having a door opening in one of said walls. The oven also includes a door moveable between an open position and a closed position for allowing the insertion and withdrawal of said workpiece from the oven chamber through the door opening, the door including a heater for heating the door to emit radiant energy into the oven chamber. The oven further comprises an inflatable seal carried by either the door or the housing, the seal extending about the area of contact between the door and the housing, the seal being filled with a nitrogen-containing gas.

DETAILED DESCRIPTION OF THE PREFERRED EMBODIMENT

Figure 2:
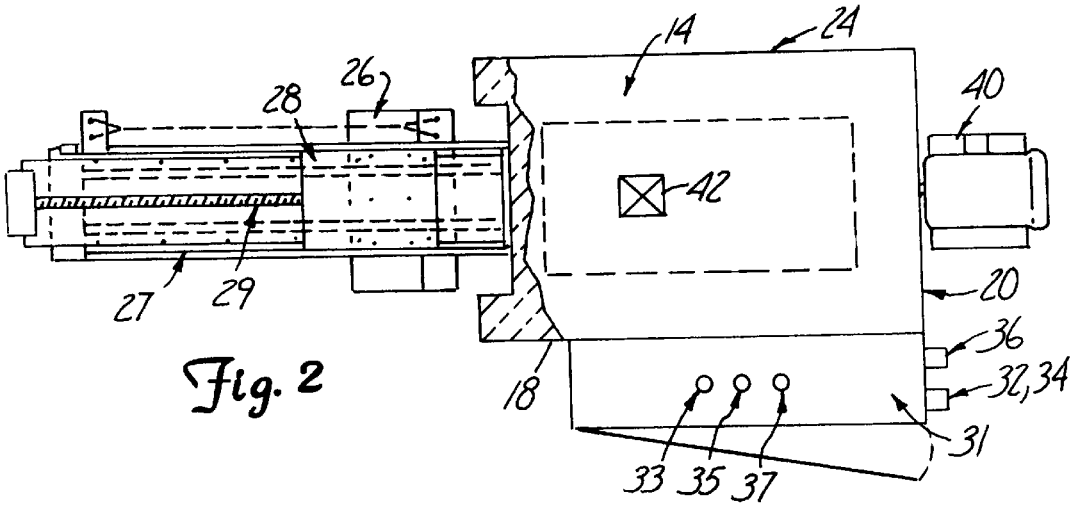
FIG. 2 is a top view of the oven depicted in FIG. 1.

FIGS. 1–4 illustrate the exterior of a preferred embodiment of the temperature controlled oven 10 for carrying out a method of the present invention in various views. The exterior or outer housing 12 has top 14, bottom 16, and side walls 18, 20, 22 and 24 with an opening 25 in one side wall 22.

Figure 7A:
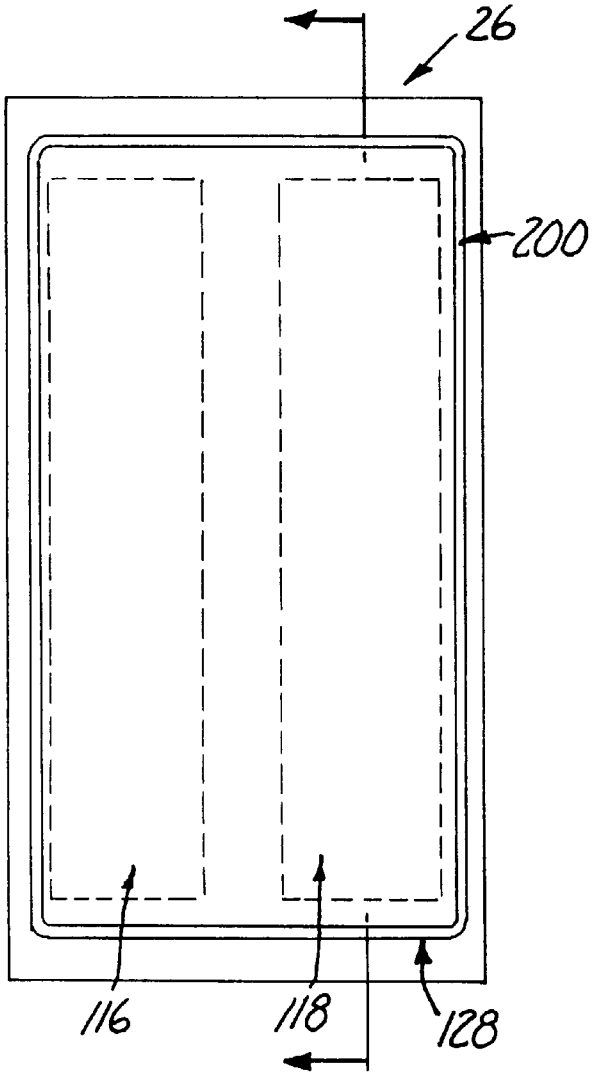
FIG. 7A is a front, interior view of the radiant heat door of the present Invention.
Figure 7B:
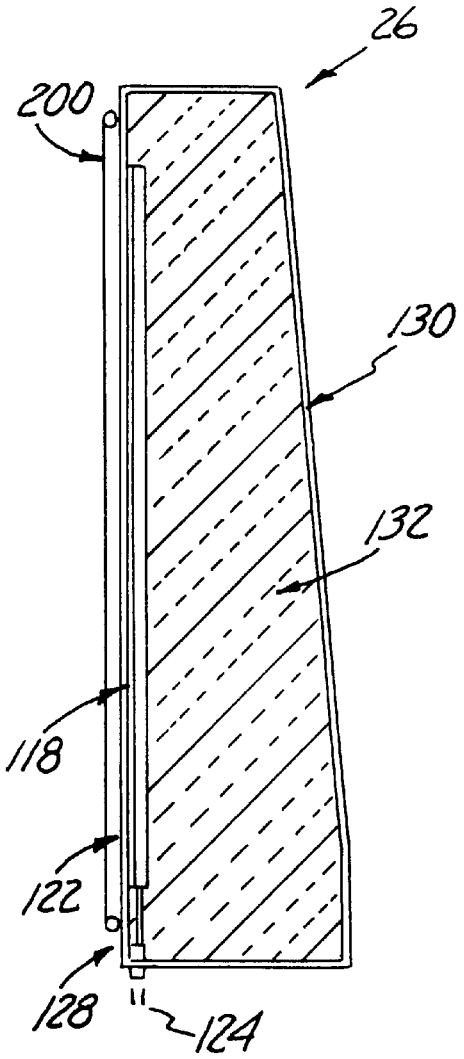
FIG. 7B is a side, sectional view, taken along the lines C—C, of the door of FIG. 7A.
Figure 8:
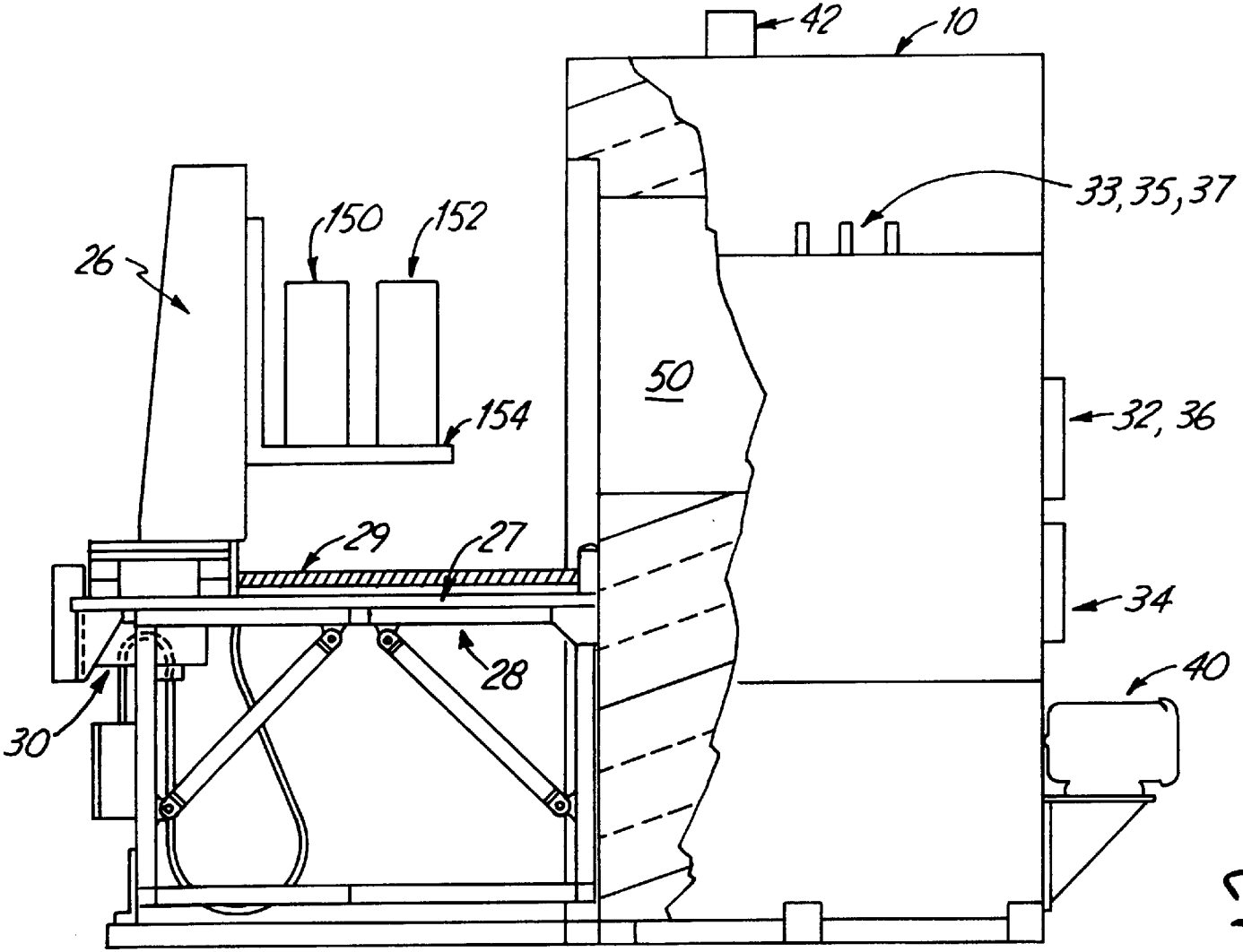
FIG. 8 is a partial side view of the oven door and door opening and closing mechanism of FIG. 1 having attached first and second magazines loaded with workpieces for movement into the oven chamber.
Figure 9:
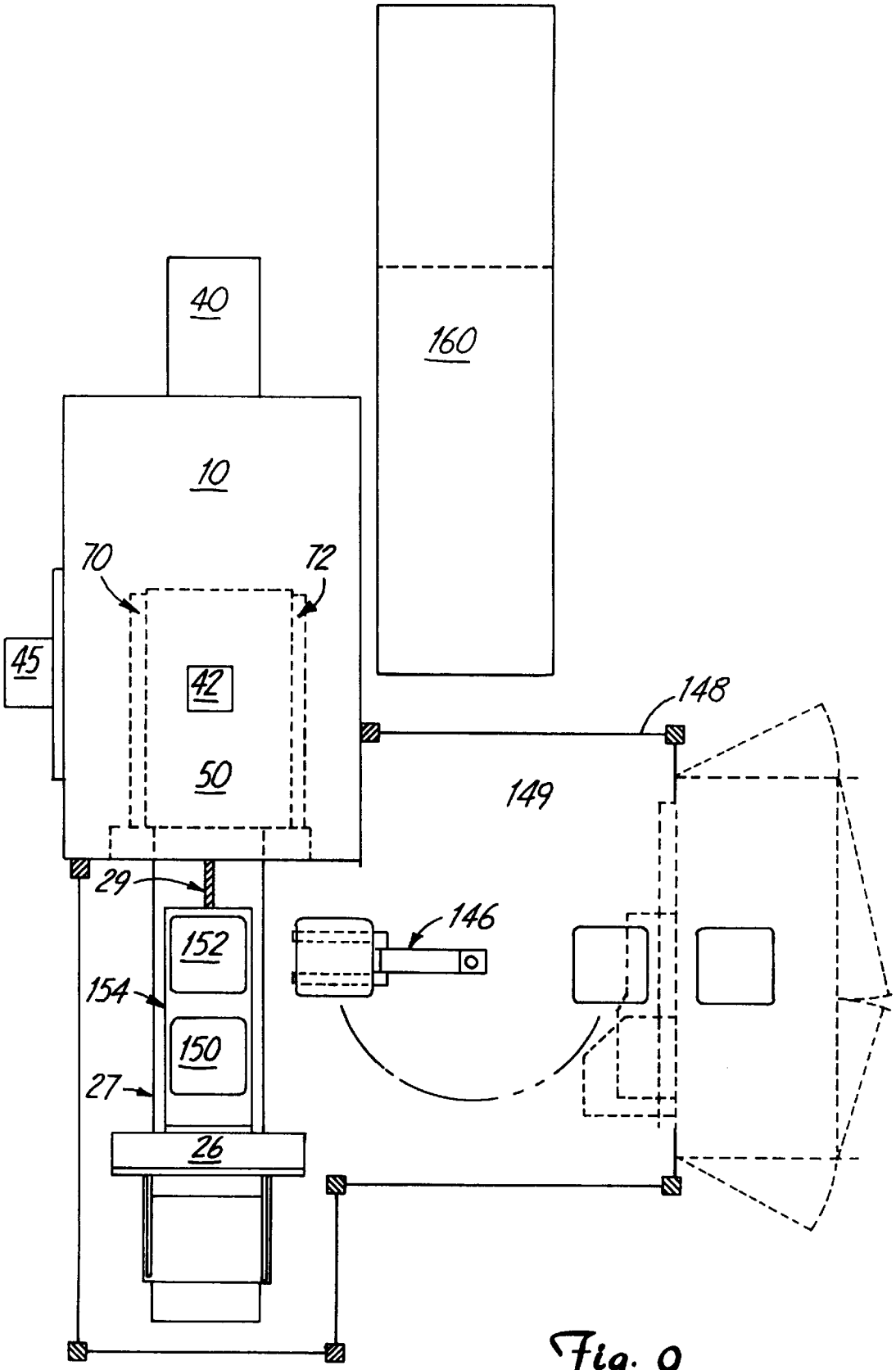
FIG. 9 is a floor plan view of the equipment for loading and unloading of the magazines depicted in FIG. 8.

The opening 25 is adapted to be closed by a door 26 that is moved laterally between open, loading/unloading and closed positions by movement of a table 28 which can be mounted on a linear bearing 27. The table 28 is desirably moved by a ball screw/nut gear mechanism 29 driven by a motor and gear drive 30 operating through pulleys and a drive belt (not shown). The table 28 carries the door 26 between open and closed positions. The door 28 is equipped with radiant heating elements for directing heat into the oven chamber and with a rack for holding magazines filled with workpieces (e.g. integrated circuits or other substrate assemblies) being subjected to heat treatment as shown in FIGS. 7–9.

Figure 1:
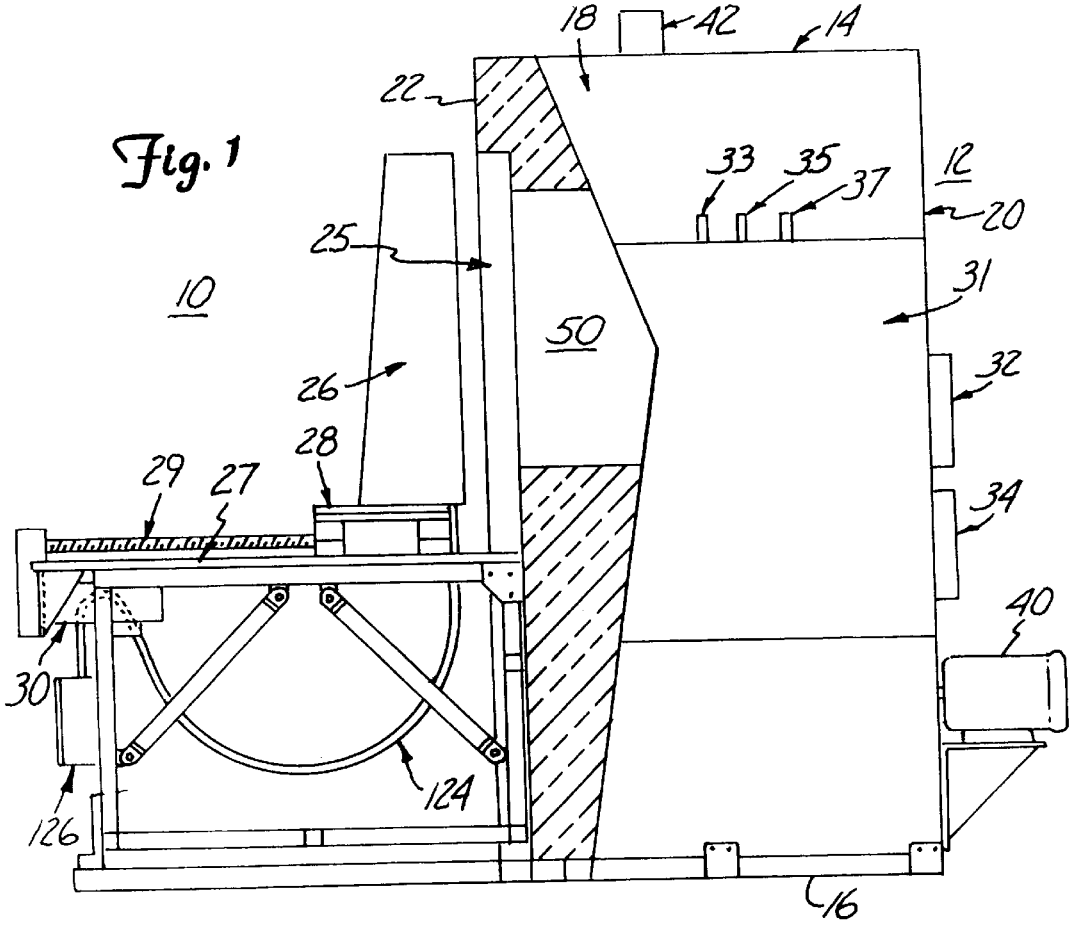
FIG. 1 is a side elevation view of a temperature controlled oven useful in carrying out the method of the present invention.
Figure 3:
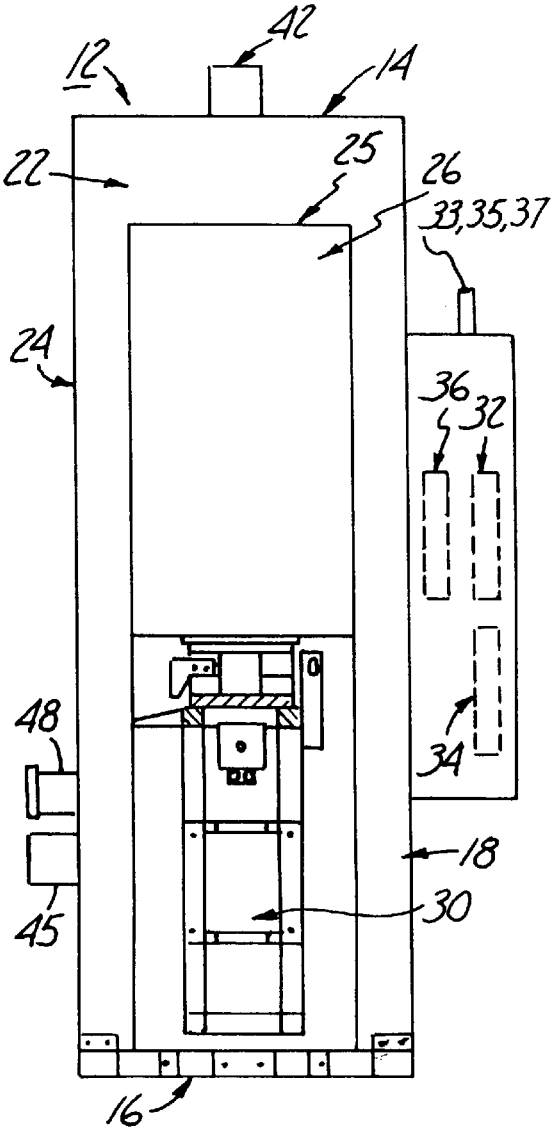
FIG. 3 is an end elevation view of the oven of FIG. 1.

An exterior housing 31 adjacent to the side wall 18 includes valves that regulate the flow of nitrogen gas, air and water through inlet pipes 33, 35 and 37 which are respectively monitored by nitrogen, air and water flowmeters 32, 34 and 36 depicted generally in FIGS. 1–3. A motor 40 operates a fan (depicted as 102 in FIGS. 4 and 5) for recirculating heated gas within an enclosure (depicted as 80 within the oven 10 in FIG. 5). An exhaust vent 42 extends from the top wall 14 and is provided to exhaust heating gas depending on internal temperature conditions.

Figure 4:
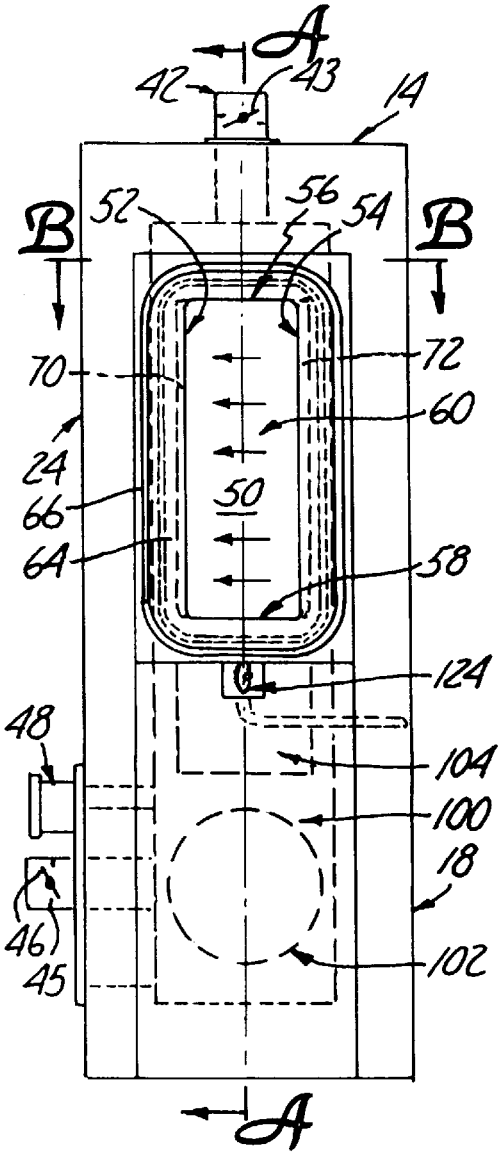
FIG. 4 is an end elevation view of the temperature controlled oven of FIG. 1 with the door assembly removed.

Turning now to FIGS. 3 and 4, they depict end elevation views of the temperature controlled oven 10 with the door 26 closed and open, respectively. FIG. 4 in addition displays in broken lines certain of the interior components of an inner oven chamber 50 having opposed side walls 52 and 54, top and bottom walls 56 and 58 and an end wall 60. The oven chamber also advantageously includes a peripheral flange 64 extending generally laterally outwardly from the opening defined by these two sidewalls and the top and bottom walls.

The heated inner chamber 50 fits within the opening 25 and the outer housing 12 and is the heat treatment chamber that receives the workpieces for heat treatment. The inner chamber 50 is preferably constructed of stainless steel and defines an oven chamber that is closed by action of the door 26 against the flange 64 of the chamber opening and a seal 66, which may comprise an inflatable O-ring type seal. The O-ring 200 may be carried by the door, as shown, or by the flange 64 of the inner chamber 50. The O-ring must simply be positioned so that it will serve to effectively substantially seal the oven chamber from the exterior environment when the door is closed and the O-ring is inflated.

The O-ring is desirably formed of a relatively flexible polymeric material adapted to withstand relatively high temperatures, such as a high temperature silicone or viton. In order to limit or prevent degradation of the O-ring, it may be useful to provide a cool water conduit 67 for maintaining the temperature of the flange 64 adjacent the seal 66 below a maximum temperature of the O-ring.

Figure 10:
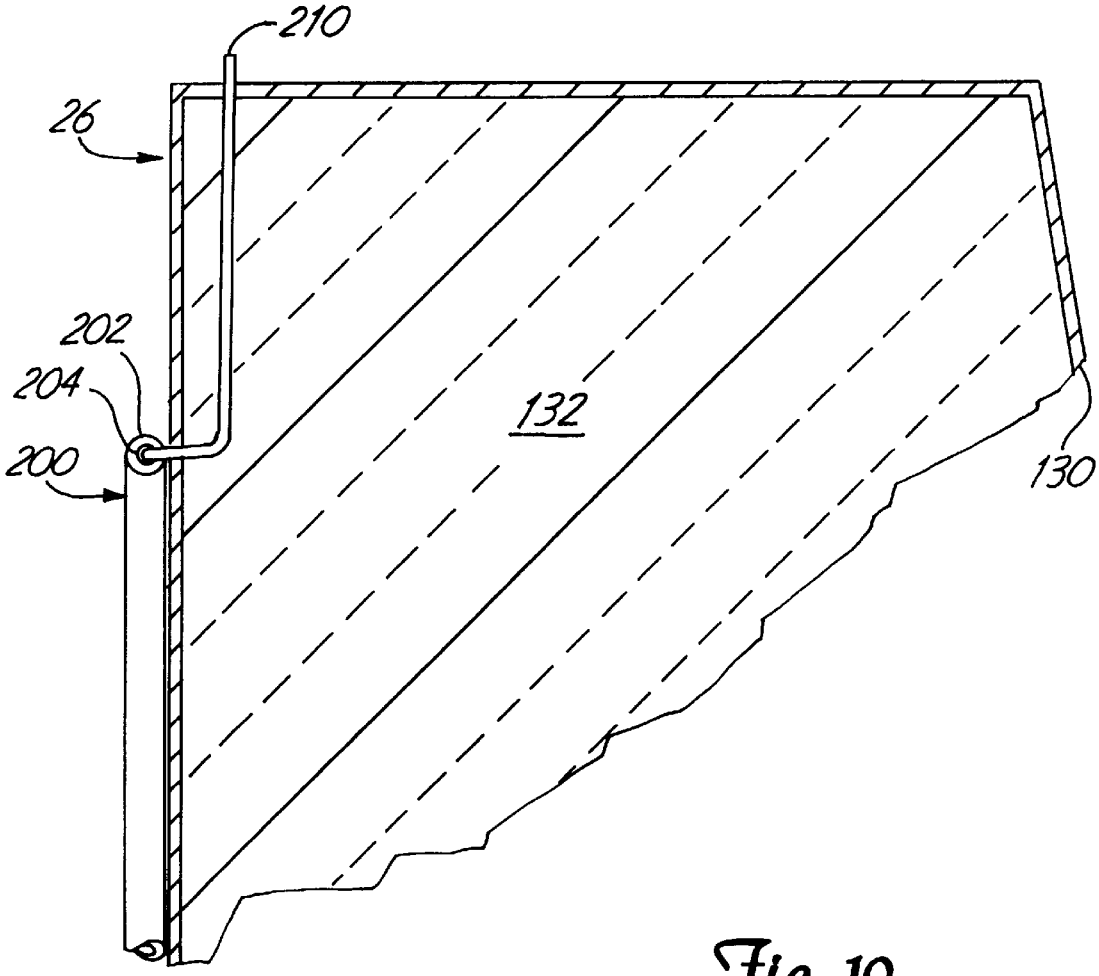
FIG. 10 is a schematic, cross-sectional view of a portion of the oven door showing detail of the O-ring.

As best seen in FIG. 10, the O-ring 200 in its relaxed state (e.g. when the door is in its open position) is desirably a generally tubular structure 202 defining a generally tubular space 204 within the interior of the O-ring. This space can be filled with any suitable gas, or placed under vacuum to collapse the O-ring, to yield the desired sealing properties.

In accordance with one embodiment of the present invention, the O-ring is inflated with a substantially anaerobic gas. In the event that the O-ring ruptures or otherwise leaks the inflating gas contained therein, this will prevent the ingress of oxygen into the oven chamber which could otherwise occur if the O-ring were inflated with air. The anaerobic gas can be substantially any gas which has limited reactivity with the workpiece being treated within the oven chamber. For many micro-electronic devices, for example, the gas within the O-ring may comprise an anaerobic nitrogencontaining gas, such as a gas which is substantially entirely nitrogen, or nitrogen containing a reducing agent, such as up to about 4% hydrogen, to minimize the effects of any oxygen which may leak into the tubular space of the O-ring over time.

This O-ring can be inflated and deflated each time it is used, with the ring being deflated when the door is open and inflated when the door is closed. If the O-ring is to be so inflated and deflated, the door may include a gas supply 210 in fluid communication with the tubular space 204 in the O-ring for delivering the anaerobic gas for inflation and releasing the gas from the O-ring for deflation. However, the O-ring need not be inflated each time the oven is used. Instead, it can inflated when the oven is installed and whenever the O-ring needs to be replaced during routine maintenance or to replace a defective O-ring, the O-ring may be reinflated with an anaerobic gas or replaced with a new O-ring which is inflated with an anaerobic gas.

The walls forming the inner chamber 50 are supported within the enclosure 80 by attachment of the flange 64 of the chamber to the surrounding the door opening 25 depicted in FIG. 4. This attachment is desirably made substantially air-tight, such as by welding.

For reasons explained more fully below, the side walls 52 and 54 of the inner chamber 50 are perforated with a large number of small diameter holes. In one embodiment, each of these walls includes five such holes per square inch for, in one instance, a total of 2700 holes. These small diameter holes may be formed by laser machining or the like and have a diameter of about 0.015 inches. It is to be understood, though, that the relative size and spacing of these holes may be varied as necessary to achieve the desired flow rates of gas through the holes, as described below.

Behind the perforated side walls 52 and 54 are gas supply and exhaust distribution chambers or plenums 70 and 72, respectively, which are sealed to the top and back walls of the inner enclosure and are coupled through supply and return manifolds 74 and 76, respectively, (illustrated in FIGS. 5 and 6) to a source and exhaust for a filtered gas, which may be an inert gas such as nitrogen. The distribution chambers or plenums 70 and 72 are formed by rectangular, box-like enclosures which substantially seal the interior of the chambers or plenums from the heated gas and cool-down gas circulating within the enclosure 80. The plenums 70 and 72 on opposed sidewalls 52 and 54 of the oven chamber are attached to the supply and return manifolds 74 and 76, respectively. These plenums 70 and 72 are bounded on the enclosure chamber sides by the perforated side walls 52 and 54, which permits inert gas delivered by the supply manifold 74 to pass into the oven chamber 50 through the holes in the side wall 52 and to exit from the oven chamber through the holes in the other side wall 54 and into the return manifold 76.

Figure 6:
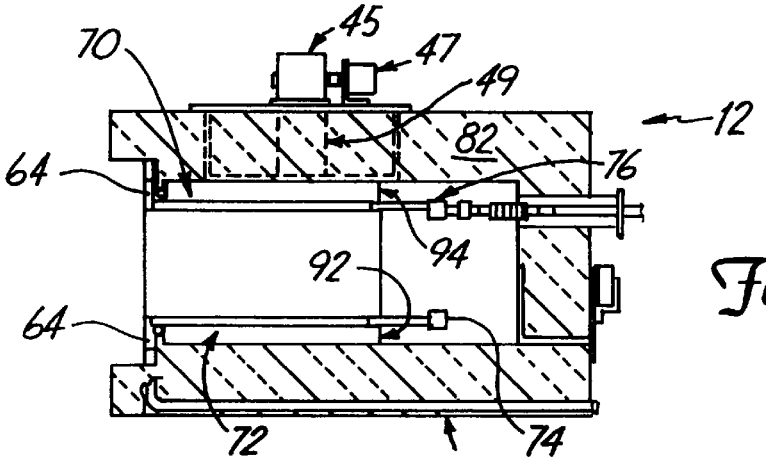
FIG. 6 is a top cross-section view taken along lines B—B of FIG. 4.
Figure 5:
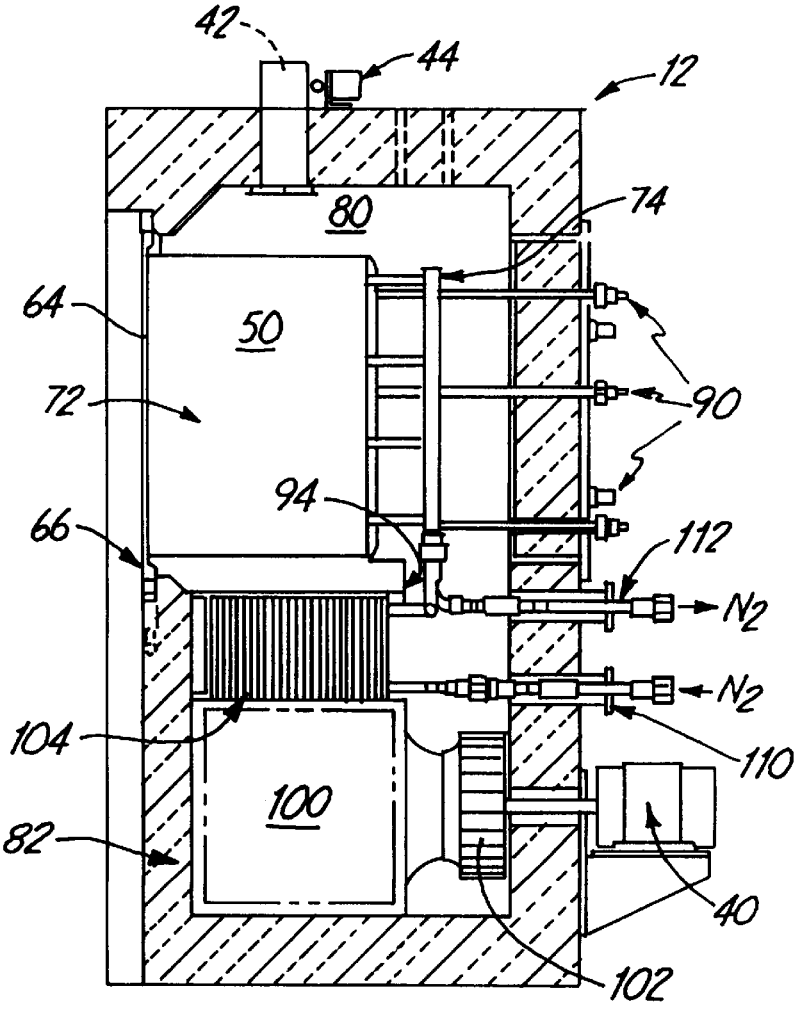
FIG. 5 is a side elevation, cross-section view taken along lines A—A in FIG. 4.

As shown in FIGS. 4–6, an exhaust vent 42 for venting heated gas to the atmosphere includes a damper 43 operated by a damper motor 44. A fresh gas inlet vent 45, which also includes a damper 46 operated by a damper motor 47, is provided for introducing cooling gas into the enclosure 80. Generally speaking, the dampers on both the exhaust vent 42 and the fresh gas inlet vent 45 are closed during the soak period at the treatment temperature and at least a portion of the heat up period to maintain an even desired temperature in the inner chamber 50 as an inert gas is recirculated within the enclosure 80. During cool down, the exhaust damper 43 and fresh gas inlet damper 46 are opened, and fan 102 draws in ambient air or another supplied gas through the fresh gas inlet and exhausts gas through the exhaust vent 42 to cool the walls of the oven chamber. The operation of these dampers in connection with the method of the invention is set forth below.

Referring again to FIGS. 5 and 6, they illustrate side and top, cross-section views taken along lines A—A and B—B, respectively, of FIG. 4. These two figures depict the enclosure 80 formed by the outer walls of the outer housing 12 and the walls of the inner, heat treatment chamber 50. The enclosure 80 is partially filled by a layer of insulation 82 adjoining the interior surfaces of the exterior walls 14, 16, 18, 20, 22 and 24 except in the area of the door opening 28. A series of baffle plates 92 and 94 attached to the inner surface of the sidewalls 18 and 24 of the outer enclosure direct the flow of heated gas within the enclosure 80. The layer of insulating material 82 heat insulates the exterior walls from the external environment and allows retention of the heat within enclosure 80.

Recirculating gas is heated within the enclosure 80 by a heater (not shown) disposed within the heater housing 100, and the heated gas (or other gas) is circulated by a fan 102 driven by motor 40. The heater may be of any type suitable for generating a sufficient gas flow volume at the desired temperature. A resistance heating element has been found to work well. The heater and heater housing 100 are advantageously readily removable from the enclosure 80, such as for maintenance or replacement. The heater and the housing can be made as a single unit which can be readily connected and disconnected to the rest of the oven via modular connections.

In one exemplary embodiment, the heated gas is first directed upward behind and over the rear and top walls (60 and 56, respectively) of oven chamber 50. The heated gas is then directed downwardly adjacent the sidewalls 52 and 54 by the baffle plates 92 and 94 carried by these walls. The gas is then directed along the bottom wall 58 by another baffle plate (96 in FIG. 5), which then directs the gas flow through a heat exchanger 104 mounted below the bottom wall and carried by the baffle plate 96.

The heated gas thus circulates directly against the outer surfaces of the walls 56, 58 and 60 of the oven chamber 50, and against the outer walls of the plenums 70 and 72. The heat supplied to the plenums 70 and 72 is then transferred by the plenums to the sidewalls 52 and 54 of the oven chamber, thereby heating five of the six sides of the oven chamber 50. The heated walls of the inner chamber thereby radiantly heat work in process placed in the oven chamber 50 in a manner described below.

In addition, the nitrogen or other gas passed through the chamber 50 is preheated in the heat exchanger 104 before it is directed through the supply manifold 74. In a preferred embodiment, an inert gas such as nitrogen gas is passed through a Class 1 filter before being introduced to the pipe connection 110. The gas then passes through the heat exchanger 104 before it is directed to the supply manifold 74 and passed into the gas supply manifold 74. Since the circulating hot gas heats the plenum 70 housing this supply manifold, the nitrogen gas is preheated to substantially the same temperature as the articles within the oven chamber 50 before it is introduced to the chamber. This helps eliminate any temperature variations in the oven cavity which could occur if relatively cool gas were introduced through the supply manifold.

The heated nitrogen gas passes through the plurality of distributed holes in the second enclosure side wall 54 and desirably passes laterally through the oven chamber 50 and flows over work in process, e.g. integrated circuits or other substrate assemblies, placed therein. After the gas makes a single pass through the chamber 50, it is evacuated through the holes in the opposite side wall 52, is passed through the evacuation chamber and return manifold, and is directed back out the exhaust pipe connection 112.

The use of relatively small holes in the sidewalls will help provide a fairly diffuse flow of nitrogen or other gas through the chamber 50 and helps establish laminar flow through the chamber. This diffuse, laminar flow will help minimize any temperature variations or surface irregularities on the work in process which could occur if less diffuse gas flows were utilized.

The exhaust pipe connection 112 is connected to an aspirator (not shown) that helps to maintain a positive pressure in the oven chamber in inner chamber 50. Gas exiting the exhaust system is then directed to the external environment by an exhaust fan or the like. In this manner, a heated inert gas may be used to bathe the work in process and purge the chamber of oxidizing compounds such as air, as well as gases and particles emitted from the workpieces during the heating process, without significantly adversely affecting temperature uniformity or surface quality of the product treated in the oven.

In the initial heat-up phase of the heat treatment cycle, this gas supply may be used to flush the oven chamber with the inert gas to substantially remove any oxygen within the oven chamber before the temperature in the oven reaches a critical temperature above which oxidation damage to the workpiece may result; for many LSI circuit chips, this temperature is typically about 125° C.

In order to maintain relatively uniform temperature distribution within the oven chamber, the door 26 is desirably provided with a separate heating system. In one preferred embodiment, the door is fabricated with resistive heating elements 116 and 118 forming a heating array 120 within the door body in a manner depicted in FIGS. 7*a* and 7*b*. The resistive heating element array 120 is coupled through a copper heat transfer layer 122 to heat the interior surface 128 of the door 28. The door 28 may be insulated by a layer of insulation 132 between the resistive heating array 120 and the outer surface 130 of the door. The resistive heating array 120 is desirably electrically connected to a power supply 126 by a flexible power cable 124 extending beneath the table 28 as shown in FIGS. 1 and 4.

Referring to the embodiment depicted in FIGS. 1 and 8, the door 26 is shown mounted on a linear bearing 27 attached to a table 28 extending generally horizontally outwardly from the opening of the cavity 50. A drive mechanism 29, which may be a drive screw driven by a motor 30 mating with threads in the base of the door (not shown), is used to move the door 26 laterally on the table 28 along the linear bearings 27. The door may be moved between an open position, illustrated in FIG. 8, for loading and unloading of workpieces, and a closed position wherein the interior surface 128 of the door abuts the flange 64 around the periphery of the chamber 50.

As noted above, the door 26 is in its open position, illustrated in FIG. 8, when the workpieces are loaded into or unloaded from the oven. If so desired, a plurality of workpieces can be carried in magazines 150 and 152 or the like to facilitate automated loading and unloading. In a preferred embodiment, the workpieces are supported by a door mounted rack 154. This rack is desirably adapted to place the workpieces carried thereon in substantially the center of the oven chamber 50. By generally centering the workpieces in the chamber 50, the variability of heat treatment associated with proximity to a heated wall of the chamber may be minimized.

In one embodiment, the loading operation is carried out as follows. Initially, the motor 30 is actuated to move the door 26 to position the first magazine 150 at an appropriate location for loading workpieces. As described below, a robot 146 may be used to load a workpiece into the first magazine on the rack 154 of the door. After the workpiece is placed in the first magazine, the door is moved rearwardly (to the left in FIG. 8) to position the door for loading a workpiece into the second magazine 152. The next workpiece may then be loaded onto the second magazine by the robot.

This loading sequence continues until all substrates have been loaded on the magazines 150 and 152, and the door 26 is closed by moving it along the linear bearings 27 until it firmly engages the flange 64 of the oven chamber 50. the seal 66 described above may then be inflated (e.g. with nitrogen), and the process cycle for heat treating workpieces according to a predetermined time and temperature profile can begin. After the process cycle is completed and the workpieces are cooled to some terminal temperature of the heat treatment process, desirably about 60° C. or so to limit thermal shock to the workpieces, the door 26 can be opened. The workpieces may then be unloaded from the magazines by the robot arm in a manner similar to the reverse of the loading sequence outlined above.

While micro-electronic devices are typically stable in the presence of oxygen at room temperature so they can be used in ambient air environments, they are frequently sensitive to the presence of oxygen when they are being heat treated at an elevated temperature. For example, LSI circuit chips are commonly formed by heating each successive layer for a period of time at a temperature in excess of 300° C. While these layers tend to be relatively stable in the presence of oxygen below about 125° C., when the temperature adjacent the workpiece substantially exceeds this threshold temperature, oxidation damage to the workpiece can result. Although the oxidation may be relatively minor, even relatively small defects such as this can result in faulty products when the scale of these flaws is considered in light of the scale of the circuits typically formed on these chips.

As noted above, this oven is particularly well suited for use in connection with oxygen-sensitive workpieces, including micro-electronic devices such as LSI circuit chips. In one embodiment, the present invention provides a method of heat treating an oxygen sensitive workpiece, which may advantageously utilize a temperature controlled oven 10 such as that outlined above. The method is intended to minimize the risk of oxidation damage to the workpieces while maximizing efficiency of oven operation.

In accordance with a method of the invention, an oven is provided, the oven having an oven chamber and an outer housing defining an enclosure therebetween. In the illustrated embodiment, the oven chamber is designated 50, the outer housing is designated 12 and the enclosure is designated 80. It is to be understood, though, that the method of the invention could be practiced with ovens having different designs than that of the oven illustrated in the attached drawings.

Once the oxygen-sensitive workpiece(s) are inserted in the oven chamber, the door 26 can be moved into its closed position as described above. If an inflatable O-ring 200 in accordance with another embodiment of the invention is employed, an "inert" gas can then be delivered to the tubular space 204 in the O-ring to inflate it. As used herein, the term "inert" in reference to a gas will depend at least in part on the workpiece being heat treated and the treatment temperature. In particular, an inert gas in this context could be virtually any gas which is either substantially non-reactive with the workpiece at the relevant heat treatment temperatures or otherwise can be used in the presence of the workpiece without substantially degrading the quality of the heat treated product.

For example, when heat treating LSI circuit chips, nitrogen can typically come into contact with the chips being treated without any material adverse effects on the quality of the product. Hence, when the workpiece is a LSI circuit chip or the like, the inert gas supplied to the tubular space 204 in the O-ring may comprise substantially entirely nitrogen. If so desired, an amount of a reducing agent may be included in the inert gas supply to limit the effects of any oxygen which does enter the system. For example, nitrogen containing about 4% hydrogen has been found to work well in similar applications.

Once the door 26 is closed and the oven chamber 50 is substantially sealed from the environment exterior to the oven 10 and the enclosure 80, heated gas may be circulated in the enclosure to heat the oven chamber. When the heat-up phase of the heat treatment begins, the enclosure may contain some air from the previous run. If so, the damper 43 in the exhaust vent 42 may be opened and an inert, desirably substantially anaerobic gas can be supplied through the fresh gas inlet vent 45 to generally flush the air from the enclosure.

Most of the oxygen should be substantially removed from the enclosure before the temperature in the oven chamber reaches the threshold temperature for the workpiece (referred to above) to provide an inert gas within the enclosure 80. In the case of LSI circuit chips, for example, any oxygen within the enclosure 80 should be substantially purged from the enclosure before the temperature within the oven cavity reaches about 125° C.

The dampers 43,46 of the exhaust and fresh gas inlet valves (42 and 45, respectively) can then be closed so that heated inert gas can be recirculated within the enclosure to heat the oven chamber from the threshold temperature to a treatment temperature for the workpieces. The heat treatment profile for the workpiece, which will typically include a soak at one or more elevated treatment temperatures, can then be carried out by recirculating heated inert gas in the enclosure. As noted above, the temperature of the inert gas in the enclosure can be controlled by means of the heater in the heater housing 100 to achieve this heat treatment profile. As explained above, the door 26 includes a heating element to heat the door. The temperature of the door is desirably maintained with these heating elements at about the same temperature as the walls of the walls of the rest of the oven chamber to ensure greater temperature uniformity within the oven chamber.

Once the heat treatment is substantially completed, the temperature in the oven chamber can be reduced by cooling the gas being recirculated within the enclosure. If so desired, this may start out relatively slowly by simply reducing the heat supplied to the recirculating gas by the heater. Desirably, though, this cooling is enhanced by introducing a cooler gas through the fresh gas inlet valve 45 and allowing some of the hotter gas in the enclosure to escape through the exhaust valve 42 by opening the dampers 46,43.

As explained below, it is important to maintain the atmosphere in the enclosure 80 substantially inert during the hotter portion of the cool down cycle. In particular, inert gas should be circulated in the enclosure until the temperature in the oven chamber has dropped to about the workpiece's threshold temperature. Once the oven chamber has cooled to this point, the final stage of the cool down can be greatly enhanced by allowing an aerobic gas into the enclosure. This aerobic gas is optimally ambient air from around the oven 10 as this is substantially cheaper than a processed gas. If so desired, the ambient air can be passed through a filter before it is introduced into the enclosure to reduce the risk of any particulate contamination of the workpieces in the oven chamber.

Once the oven chamber has cooled to a terminal temperature, which is desirably about 60° C. or lower to minimize thermal shock to the workpiece, the door can be opened. The workpieces can then be removed from the oven chamber and a new set of workpieces can be placed in the oven chamber for heat treatment. The air introduced during the final cooling of the first set of workpieces can then be flushed from the enclosure, as outlined above. Alternatively, the air in the enclosure 80 can be flushed before the door 26 is closed on the new workpieces to avoid unnecessarily heating the air before it is flushed.

This method of the invention provides a particularly safe heat treatment oven while minimizing the cost of operating the oven. By using an inert gas to heat the oven chamber at higher temperatures, the method of the invention minimizes the risk associated with a leak in the oven chamber which could allow gas in the enclosure 80 to enter the oven chamber. If such a leak occurs, only an inert gas will enter the oven chamber, substantially avoiding the potential damage Which could occur if an aerobic gas were present in the enclosure. If sufficient oxygen were allowed into the oven chamber at operating temperatures, the entire workpiece could be ruined by oxidation damage. As the process of forming one set of multi-layered LSI circuit chips can take months, this risk is substantial.

Inert gases, even nitrogen, can be relatively expensive, though. The present invention can use ambient air when the oven chamber temperature drops below the threshold temperature of the workpiece to complete the cooling process, reducing the cost associated with providing substantial volumes of inert gas to cool down the oven chamber. Since this method only employs air when the oven chamber is at lower temperatures, though, even if there is a leak in the oven chamber which admits air from the enclosure into the oven chamber, there should be little or no oxidation damage to the workpiece.

If so desired, an oven as outlined above can be used in an alternative manner. If the risk of a leak from the enclosure 80 into the oven chamber 50 is not substantial or if a leak is unlikely to cause very serious repercussions, one could use an oven of the invention by circulating air rather than an inert gas within the enclosure. Alternatively, if the product is particularly sensitive to any oxygen, it may be advantageous to maintain an inert atmosphere within the enclosure through the entire heat treatment cycle. Although such a process is not within the scope of the method of the present invention, it is to be understood that an oven having a door seal in accordance with the other embodiment of the invention could be used in such a fashion.

FIG. 9 depicts one useful means for the loading and unloading of workpieces, e.g. substrates for integrated circuits and the like, into and out of the oven chamber 50 for heat treatment. The oven is desirably located in a clean room, which is optimally a Class 1 environment, adjacent to automated or remote controlled robotic equipment which handle the workpieces so that human interface with, and possible contamination of, the workpieces is minimized.

As shown in FIG. 9, the oven 10 is optimally attached to an enclosed wall system 148 so that the door 26 and table 28 are enclosed in a clean-room environmental enclosure 149. Magazines carrying the workpieces may be loaded onto and unloaded off of the door rack 154 by a three axis robot 146 which picks up magazines and transfers them between a loading station 156 and the oven. As schematically illustrated in FIG. 9, a computer-based controller 160 may be positioned outside the environmental enclosure 149 so operators can access a keyboard or the like to control the operation of the system.

In one preferred method of operation, the work in process is substantially entirely isolated from human contact throughout the fabrication process. In some circumstances, it may be necessary to repeatedly move a workpiece from a fabricating station (not shown) where, for instance, a layer of a material is applied to a workpiece, and the oven, where the workpiece is heat treated. In such a situation, it may be desirable to enclose a magazine filled with workpieces in an enclosure, referred to as a "pod", for transfer between the oven and other areas of the fabrication facility. These pods may be substantially isolated from the surrounding atmosphere during transfer operations, allowing portions of the facility to be "dirty", i.e. not maintained at high clean room standards. It may be necessary to include handling equipment in the loading station 156 to open a pod to remove the magazine(s) therein.

A temperature controlled oven in accordance with the present invention is particularly well suited for use in the fabrication of micro-electronic devices such as multi-layered LSI circuit chips, where high standards of cleanliness and temperature uniformity and control are of paramount importance. The substrates or integrated circuits are placed in the magazines which are inserted into the oven chamber with the closure of the door and are then exposed to a selected temperature profile, depending on the requirements of the manufacturing process specification.

Each temperature profile has a specified time and corresponding temperature cycle. For example, time cycles commonly used in manufacturing integrated circuit chips may vary in length from 3–4 hours to 10 hours or more. The temperature cycles start at ambient temperature when the door is closed and typically include relatively gradual temperature increases up to a target treatment temperature (e.g. 400° C.), soak times at specified temperatures, and a controlled cool down period.

During the entire temperature cycle, the flow rate of gas through the oven chamber 50 is desirably maintained at constant rate. Depending on the nature of the workpiece, this flow rate will usually range between 5 an 10 SCFM (standard cubic feet per minute). The heated gas is usually circulated in the enclosure 80 at a much higher rate, e.g. 1000 SCFM, to maximize temperature uniformity of the walls of the chamber 50. During the entire cycle, a positive pressure (e.g. 0.5 inches water column) is maintained in the oven chamber by restricting the outflow of the inert gas to limit the influx of air or other potential contaminants into the chamber 50 through any leaks in the oven chamber.

The oven as described above is characterized as an "ultra clean oven", wherein the number of particles per cubic foot of the oven chamber determines the class of cleanliness. For example, the Class standards are as follows:

1 particle/$ft^3$ 0.5 micron or larger is Class 1

10 particles/$ft^3$ 0.5 micron or larger is Class 10

100 particles/$ft^3$ 0.5 micron or larger is Class 100

The oven design described above has been found to achieve a superlative state of cleanliness, satisfying Class 1 to Class 10 standards.

The cleanliness of the oven chamber can also be determined by measuring the number and size of particles accumulating on a test sample over a specified time. The number and size of particles on an ultra clean, polished, silicon wafer test sample may be counted and measured by known means prior to placing the test sample in the oven chamber. After the heat treatment cycle is run, the number and size of particles added during the cycle are counted and measured. for example, in certain applications, no more than five (5) 0.5 micron size particles can be added to the workpiece per half-hour of heat treatment. An oven in accordance with the present invention has been found to meet these demanding standards without significantly sacrificing temperature uniformity in the oven chamber or unduly hampering manufacturing operations.

The above-description of one preferred embodiment of the invention contemplates the use of radiant heating, and in particular a resistively heated oven door and five gas-heated walls, in conjunction with an inert atmosphere oven. It will be appreciated that the resistively heated door may have applications for conventional forced or gravity convected ovens as well as other types of resistive heated radiant ovens in addition to the radiant heat oven described. These and other modifications changes and substitutions of equivalence for the structure disclosed in relation to the preferred embodiment of the invention will be apparent to those of skill in the art.

While a preferred embodiment of the present invention has been described, it should be understood that various changes, adaptations and modifications may be made therein without departing from the spirit of the invention and the scope of the appended claims.

What is claimed is:

1. A method of heat-treating an oxygen-sensitive workpiece comprising:

a. Providing an oven having an oven chamber and an outer housing defining an enclosure between the oven chamber and the outer housing;

b. Placing the oxygen-sensitive workpiece into the oven chamber and sealing the oven chamber from the exterior environment and the enclosure;

c. circulating heated inert gas within the enclosure to increase the temperature within the oven chamber from a threshold temperature which Promotes oxidation damage to the workpiece to a higher treatment temperature;

d. circulating heated inert gas within the enclosure to hold the temperature within the oven chamber at or above said treatment temperature;

e. circulating inert gas within the enclosure to reduce the temperature within the oven chamber from said treatment temperature to said threshold temperature; and f. circulating an aerobic gas within the enclosure to reduce the temperature within the oven chamber from said threshold temperature to a cooler terminal temperature.

2. The method of claim 1 wherein the aerobic gas comprises ambient air.

3. The method of claim 2 further comprising the step of filtering said ambient air prior to introducing the air into the enclosure.

4. The method of claim 1 further comprising the step, prior to step C, of increasing the temperature within the oven chamber from about ambient temperature to about 125° C. by circulating a heated gas comprising air within the enclosure.

5. The method of claim 1 wherein the oven chamber has a door opening therein and the oven is provided with an oven chamber door adapted to engage the oven chamber door opening, the method including the step of sealing the oven chamber from the exterior environment comprising closing said oven chamber door to bring it into engagement with the oven chamber.

6. The method of claim 5 wherein said oven chamber door includes a heating element to control the temperature of said oven chamber door, the method further comprising controlling the temperature of said oven chamber door so that the heating element in said oven chamber door and the circulation of heated gas within the enclosure combine to control the temperature within the oven chamber.

7. The method of claim 5 wherein said oven chamber door the door includes an inflatable seal positioned to engage the oven chamber, the method further comprising inflating said seal with an inert gas.

8. The method of claim 7 wherein said oven chamber door includes a conduit for cooling the inflatable seal to prevent the temperature of said oven chamber door from exceeding a maximum temperature, the method further comprising circulating a cooling fluid through the conduit to maintain the temperature of the seal at no more than about said maximum temperature.

9. The method of claim 1 further comprising the step of flushing the atmosphere of the oven chamber with an inert gas to remove oxygen within the oven chamber before the temperature in the oven chamber reaches about 125° C.

10. A method of heat-treating an oxygen-sensitive workpiece comprising:

a. providing an oven having a door, an oven chamber and an outer housing, an enclosure being defined between the oven chamber and the outer housing, the door being adapted to engage the oven chamber and seal the oven chamber from the exterior environment;

b. placing the oxygen-sensitive workpiece into the oven chamber and closing the door to seal the oven chamber from the exterior environment and the enclosure;

c. flushing the atmosphere of the oven chamber with an inert gas to remove oxygen within the oven chamber before the temperature in the oven chamber reaches about 125° C.

d. circulating heated air within the enclosure to increase the temperature within the oven chamber from an initial temperature to about 125° C.;

e. circulating heated inert gas within the enclosure to increase the temperature within the oven chamber from about 125° C. to a higher treatment temperature;

f. circulating heated inert gas within the enclosure to hold the temperature within the oven chamber at or above said treatment temperature;

g. circulating inert gas within the enclosure to reduce the temperature within the oven chamber from said treatment temperature to about 125° C.; and h. circulating air within the enclosure to reduce the temperature within the oven chamber from about 125° C. to a cooler terminal temperature.

11. A method of heat-treating an oxygen-sensitive workpiece comprising:

a. providing an oven having an oven chamber and an outer housing defining an enclosure between the oven chamber and the outer housing, the oven chamber having an external surface;

b. placing the oxygen-sensitive workpiece into the oven chamber and sealing the oven chamber from the exterior environment and the enclosure;

c. circulating a flow of heated inert gas within the enclosure in contact with said external surface of the oven chamber to increase the temperature within the oven chamber from a threshold temperature which promotes oxidation damage to the workpiece to a higher treatment temperature;

d. Establishing a diffuse, laminar flow of inert gas through the oven chamber after sealing the oven chamber from the enclosure;

e. circulating heated inert gas within the enclosure in contact with said external surface of the oven chamber to hold the temperature within the oven chamber at or above said treatment temperature;

f. circulating inert gas within the enclosure in contact with said external surface of the oven chamber to reduce the temperature within the oven chamber from said treatment temperature to said threshold temperature; and g. circulating an aerobic gas within the enclosure in contact with said external surface of the oven chamber to reduce the temperature within the oven chamber from said threshold temperature to a cooler terminal temperature.

12. The method of claim 11 wherein the inert gas flowing through the oven chamber makes a single pass through the oven chamber before being exhausted while the inert gas flowing within the enclosure is recirculated.

13. The method of claim 11 wherein the flow of inert gas through the oven chamber is delivered to the oven chamber through a manifold which is sealed from the enclosure.

14. The method of claim 13 wherein the inert gas delivered to the oven chamber is pre-heated in the manifold by the flow of inert gas within in the enclosure.

15. The method of claim 11 wherein the aerobic gas comprises ambient air.

* * * * *